United States Patent [19]

Takahashi

[11] 3,970,350

[45] July 20, 1976

[54] MATRIX PIN BOARD

[75] Inventor: Tooru Takahashi, Yokohama, Japan

[73] Assignee: Yamaichi Denki Kogyo Kabushiki Kaisha, Tokyo, Japan

[22] Filed: June 23, 1975

[21] Appl. No.: 589,773

[30] Foreign Application Priority Data

June 27, 1974 Japan ..... 49-75656

[52] U.S. Cl. ..... 339/18 P; 339/198 G; 339/198 H

[51] Int. Cl.[2] ..... H01R 25/02; H01R 9/22

[58] Field of Search ..... 339/18, 198 R, 198 G, 339/198 GA, 198 H

[56] References Cited

UNITED STATES PATENTS

| | | | |
|---|---|---|---|
| 3,345,599 | 10/1967 | Henschen et al. | 338/18 C |
| 3,350,676 | 10/1967 | McFadden | 339/18 C |
| 3,353,138 | 11/1967 | Loose | 339/18 C |
| 3,439,313 | 4/1969 | Fischer et al. | 339/198 R X |
| 3,854,790 | 12/1974 | Provinsky | 339/198 GA |

FOREIGN PATENTS OR APPLICATIONS

| | | | |
|---|---|---|---|
| 6,407,521 | 1/1965 | Netherlands | 339/198 H |

*Primary Examiner*—Joseph H. McGlynn
*Assistant Examiner*—Craig R. Feinberg
*Attorney, Agent, or Firm*—Wenderoth, Lind and Ponack

[57] ABSTRACT

A matrix pin board has a plurality of transversely and longitudinally extending I-shaped elements with the flanges having a plurality of semicircular recesses spaced at intervals along the edges thereof. The I-shaped elements are side by side to form two insulating plates with channels therethrough and the flanges abutting to define holes at the recesses therein. The bottom flanges of the uppermost elements have a plurality of T-shaped transverse recesses therein at spaced intervals therealong, and the top flanges on the lowermost I-shaped elements extend through the T-shaped recesses. The holes defined by the flanges of the elements are aligned in vertical lines extending through the channels. The elements are held in engaged relationship and conductor elements extend along the channels having holes therethrough aligned with the vertically aligned holes and individual contact portions adjacent each of the holes, and terminal means are electrically connected to each of the conductor elements and extending to a point outside of the board. Pin elements can be inserted into the aligned holes for electrically connecting the conductor element in one of the uppermost channels with the conductor element in one of the lowermost channels.

3 Claims, 13 Drawing Figures

MATRIX PIN BOARD

The present invention relates to a novel matrix pin board.

Matrix pin boards of insulating material heretofore in use are made by forming insulating plates of synthetic resin or similar materials and laying one upon another. However, this requires providing some sort of conductor arrangement either within the formed insulating plates or between the superposed plates.

The matrix pin board according to the present invention overcomes the drawbacks of the prior art pin boards by forming the insulating plates by transversely and longitudinally extending I-shaped elements of insulating material which are interlocked to form the insulating plates. The shapes of the elements are such that channels are provided through the superposed plates for conductors. This arrangement makes it possible to fabricate boards easily at a moderate price and to form different sizes of boards by varying the lengths of the elements used in making up the various plates.

Other and further advantages of the invention will become apparent from the following description of the invention, taken together with the accompanying drawings, in which.

Figure 4:
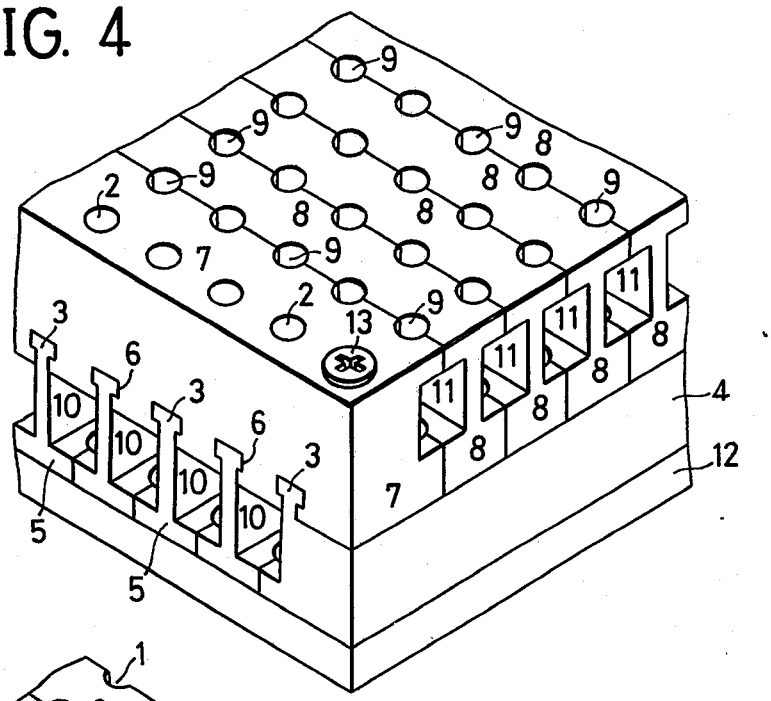
FIG. 4 is a partial perspective view of the board.
Figure 5:
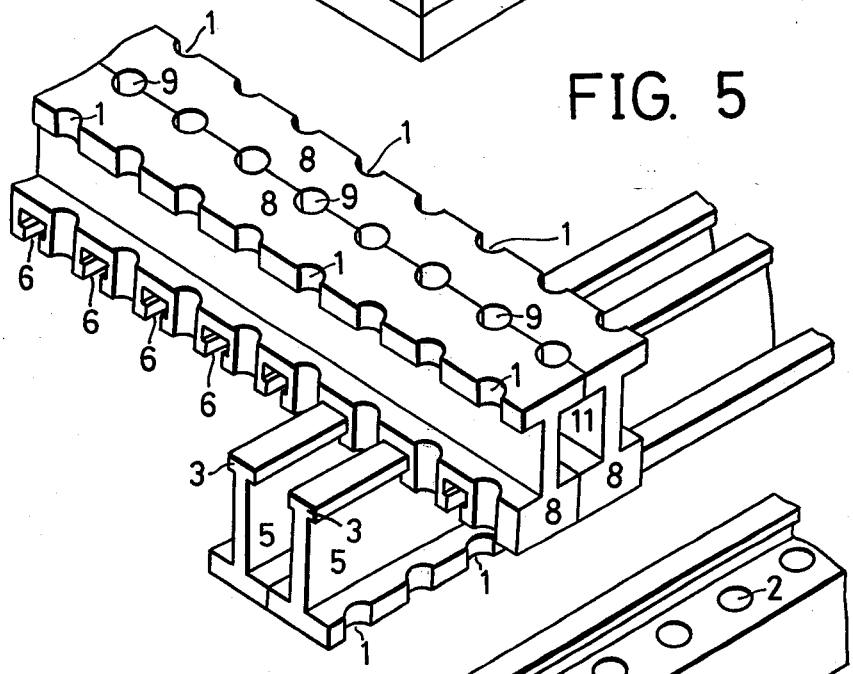
FIG. 5 is a perspective view showing how transverse insulating elements and longitudinal insulating elements are joined together.

The I-shaped elements making up the basic structure of the matrix board of the present invention are shown most clearly in FIGS. 4 and 5, and are constituted by transversely extending elements 5 of electrically insulating material having a generally I-shaped cross-section with the flange on the bottom being slightly wider than the flange 3 on the top, and the bottom flange having a plurality of semi-circular recesses 1 spaced at regular intervals along the edges thereof. The elements are further constituted by longitudinally extending elements 8 also of electrically insulating material having a generally I-shaped cross-section with the flange on the bottom being slightly thicker than the flange on the top, the top and bottom flanges both having semi-circular shaped recesses 1 spaced at regular intervals along the edges thereof, and the bottom flange having recesses 6 having a generally T-shaped cross-section extending therethrough transversely to the length of the element 8 and at positions between the positions of the semi-circular recesses 1. When the longitudinally extending elements 8 have the flanges abutted against each other to form one insulating plate, the recesses 1 form circular holes and a longitudinally extending rectangular cross-section channel 11 is formed by the flanges and the web portions of the elements 8. The spacing of the recesses 6 is such that when the upper flanges 3 of the transversely extending elements 5 are inserted through the aligned recesses 6 in the bottom flanges of the elements 8, the edges of the bottom flanges of the elements 5 abut each other to form a second insulating plate and so that the recesses 1 therein form circular holes 9 and the bottom flanges and webs of elements 5 and the bottom surfaces of the bottom flanges of the elements 8 define transversely extending rectangular cross-section channels 10. The spacing of the holes 9 defined by the flanges of the longitudinally extending elements 8 and the holes defined by the lower flanges of the transversely extending elements 5 are such that all of the holes are aligned in a vertical line extending through the channels 10 and 11.

Figure 6:
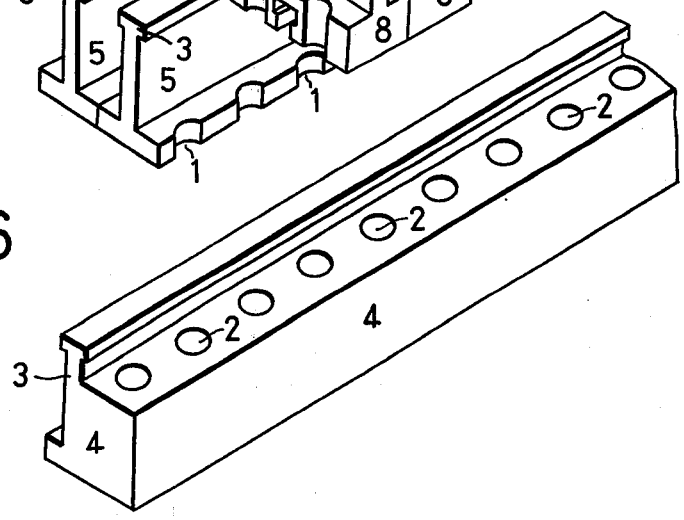
FIG. 6 is a perspective view of an element forming the front and rear edges of the board.

The element 4 forming the front and rear edges of the board, as shown in FIG. 6, has one side with the same shape as the side of the transversely extending elements 5, and the other side has the upper portion the same in shape as the transversely extending elements 5 and has the lower portion in the shape of a rectangular block with a plurality of holes 2 extending vertically therethrough at intervals so as to correspond to the spacing between holes 9 between adjacent longitudinally extending elements 8. As seen most clearly in FIGS. 4 and 9, the upper flange 3 is fitted into the aligned recessed 6 at the ends of the elements 8, while the lower flange abuts the lower flange on the next adjacent ltransversely extending element 5 to define a channel 10.

Figure 7:
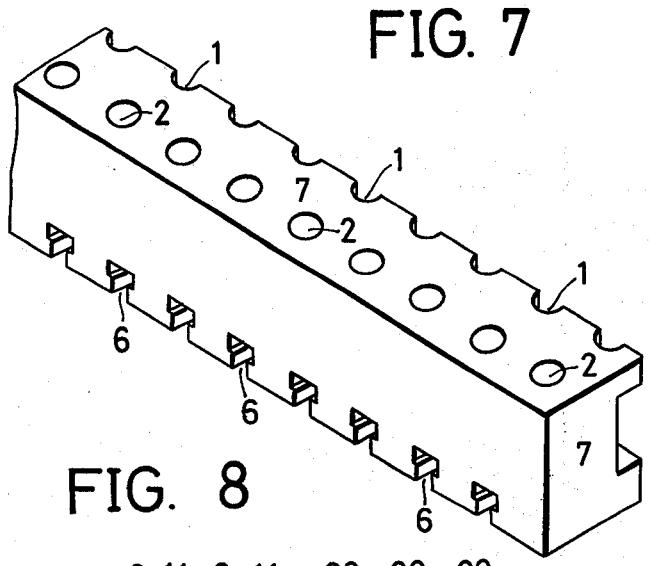
FIG. 7 is a perspective view of an element forming the left and right edges of the board.

The element 7 forming the left and right edges of the board, as shown in FIG. 7, has one side with the same shape as the side of a longitudinally extending element, and the other side is simply a rectangular cross-section block. The T-shaped recesses 6 extend through the block, so that when the side edge elements 7 are placed against the adjacent longitudinally extending elements 8 with the top flanges on the elements 5 and the front and rear edge elements 4 in the recesses 6, the side edge elements define channels 11 with the adjacent element 8. The side edge elements 7 further have vertical holes 2 therethrough which are aligned with the holes 9 defined between adjacent elements 5.

Figure 1:
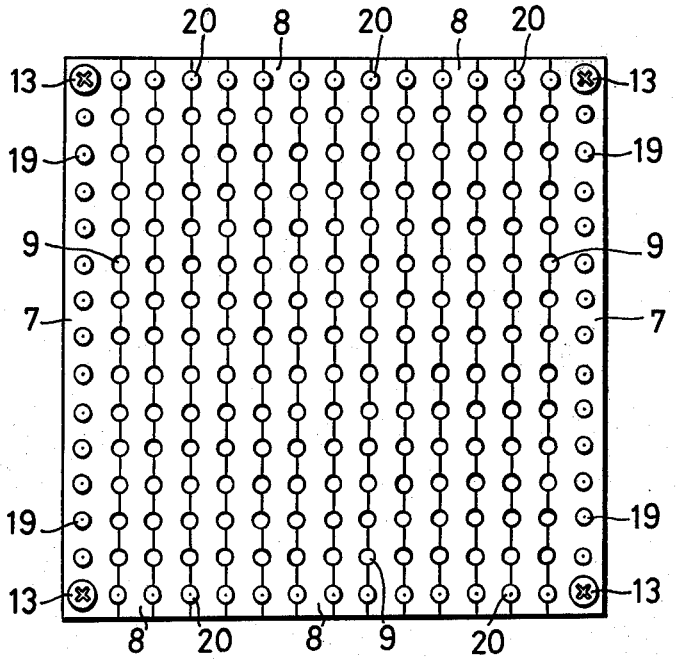
FIG. 1 is a plan view of the matrix pin board according to the present invention.
Figure 2:
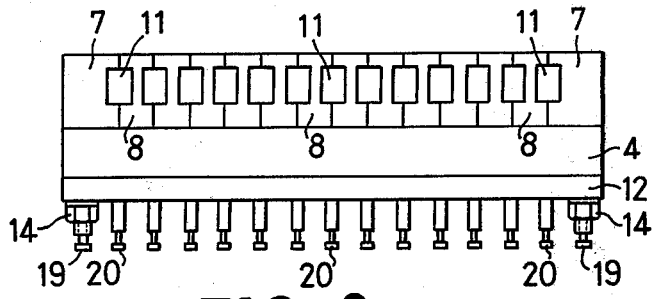
FIG. 2 is a front elevation view of the matrix pin board of FIG. 1.

At the four corners of the board, as shown in FIGS. 1 and 4, are aligned holes 2 in the respective front and rear edge elements 4 and the side edge elements 7, into which is placed a fastening means 13, 14, such as a Phillips head bolt and a nut, for holding the elements of the board together and holding them to an auxiliary board 12 forming the face element of the board. The auxiliary board 12 also has holes therein corresponding in position to the holes 9 and 2 defined by and provided in the respective elements of the board.

Positioned in each of the transversely extending channels 10 is a connector element 17, and identical connector elements 18 are positioned in the longitudinally extending channels 11. The connector element 17 is shown clearly in FIGS. 10A-10D as having a strip element having a plurality of holes 16 spaced therealong to be aligned with the holes 9 in the elements 5 and 8, and adjacent each hole is a pair of opposed reentrant contacts 15 extending upwardly from the strip element and then bent inwardly and downwardly into the space above the hole 16.

Figure 8:
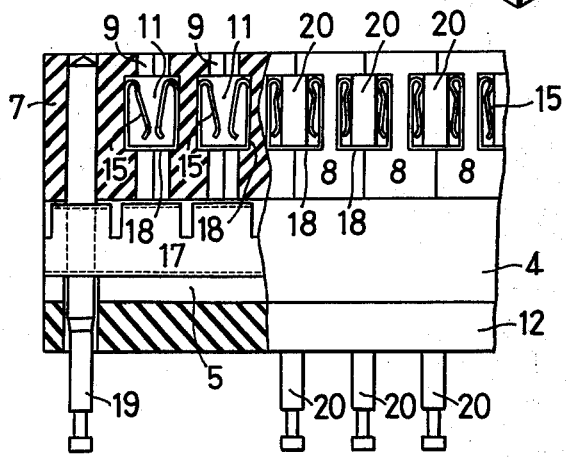
FIG. 8 is a front view of the board, partly in section.
Figure 9:
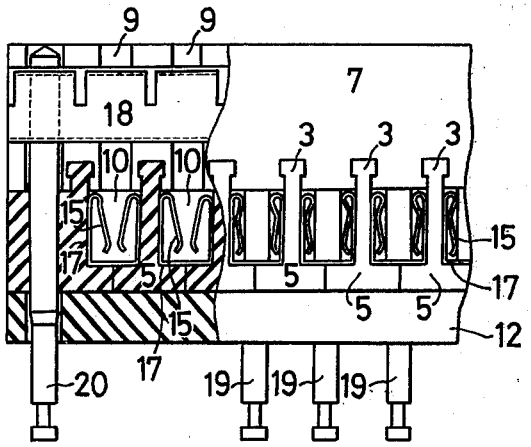
FIG. 9 is a side elevation view of the board, partly in section.
Figure 10A:
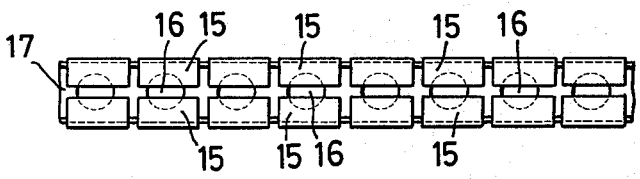
FIGS. 10A–10D are views of the conductor element for use in the board, FIG. 10A being a top plan view, FIG. 10B being a side elevation view, FIG. 10C being a bottom plan view, and FIG. 10D being a transverse sectional view.
Figure 10B:
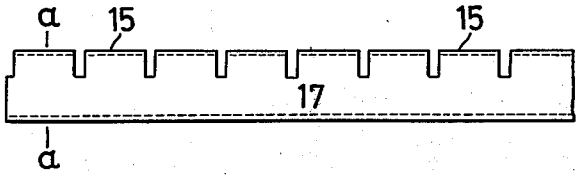
Figure 10C:
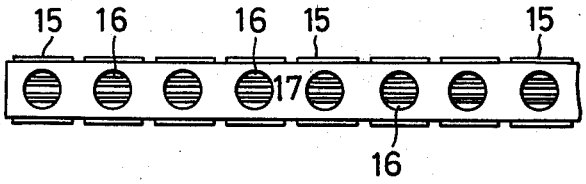
Figure 10D:
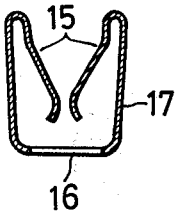

Terminal rods 20 are inserted into the holes 2 in the front and rear edge elements 4 so as to extend through the ends of the channels 11 and contact the contacts 15 on the conductor element 18 therein, as shown in FIG. 9, with the ends of the rods 20 projecting beyond the auxiliary board 12 so as to permit wires or like conductors to be attached thereto. Likewise, terminal rods 19 are inserted into the holes 2 in the side edge elements 7 so as to extend through the ends of the channels 10 and contact the contacts 15 on the conductor element 17 therein, as shown in FIG. 8, with the ends of the rods 19 projecting beyond the auxiliary board 12.

Figure 3:
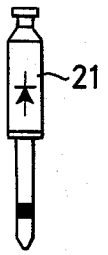
FIG. 3 is an elevation view, on an enlarged scale, of a plug for the board of FIGS. 1 and 2.

In use, when it is desired to connect one of the transversely extending conductor elements 17 in one of the channels 10 with a longitudinally extending conductor element 18 in one of the channels 11, a plug 21, as shown in FIG. 3 in which a diode is incorporated between the poles of the plug, is inserted into one of the holes 9, and the plug contacts the contacts 15 on the conductor element 18 and then passes through the hole 16 therebetween and into the channel 10 and into contact with the contacts 15 on the conductor element 17. In this way, the plugs 21 can be used to cause the board to function as a diode matrix.

It will therefore be seen that there has been provided a matrix pin board which is made up of a plurality of elements which fit together to define channels and pin holes therethrough to accommodate conductor elements and diode plugs. Because all of the similar elements are the same in shape, e.g. all of the transversely extending I-shaped elements 5 have the same shape, it is possible to manufacture them in different lengths, and thereby it becomes possible to make matrix boards of many different sizes from the same basic elements. The price of such elements is moderate and they are easy to make.

What is claimed is:

1. A matrix pin board comprising a plurality of transversely extending I-shaped elements having a bottom flange slightly wider than the top flange and having a plurality of semicircular recessed spaced at intervals along the edges thereof, said transversely extending I-shaped elements being side by side with the bottom flanges abutting to define holes at the recesses therein, a plurality of longitudinally extending I-shaped elements having a bottom flange slightly thicker than the top flange and each flange having a plurality of semicircular recesses spaced at intervals along the edges thereof, said bottom flange having a plurality of T-shaped transverse recesses therein at spaced intervals therealong, said longitudinally extending I-shaped elements being side by side with the flanges abutting to define longitudinally extending channels therebetween and holes at the recesses therein, and the top flanges on the transversely extending I-shaped elements extending through the T-shaped recesses in the bottom flanges of said longitudinally extending elements, the transversely extending I-shaped elements and the bottom flanges of said longitudinally extending I-shaped elements defining transversely extending channels therebetween, the holes defined by the flanges of said elements being aligned in vertical lines extending through said channels, means for holding said elements in engage relationship, conductor elements extending along said channels having holes therethrough aligned with said vertically aligned holes and individual contact portions adjacent each of said holes, and terminal means electrically connected to each of said conductor elements and extending to a point outside of said board, whereby pin elements can be inserted into the aligned holes for electrically connecting the conductor element in one transversely extending channel with the conductor element in one of the longitudinally extending channels.

2. A matrix pin board as claimed in claim 1 in which said means for holding said elements in engaged relationship comprise front and rear edge elements having flanges abutting the flanges of adjacent transversely extending elements and a top flange in engagement in the T-shaped recesses of said longitudinally extending elements, and a plurality of vertical holes therethrough aligned with the holes in the ends of said longitudinally extending elements, and side edge elements having flanges abutting the flanges of adjacent longitudinally extending elements and having vertical holes therethrough aligned with the holes in the ends of said transversely extending elements, the holes at the ends of the respective front and rear edge elements and the side edge elements being aligned at the corners of the board, and securing means extending through said corner holes.

3. A matrix pin board as claimed in claim 2 in which said terminal means comprise terminal rods extending through the vertical holes in said front and rear edge elements and the side edge elements and electrically contacting said conductor elements in said channels.

* * * * *